US005735970A

United States Patent [19]

Robert

[11] Patent Number: 5,735,970

[45] Date of Patent: Apr. 7, 1998

[54] APPARATUS AND PROCESS FOR THE PRODUCTION OF A NEUTRAL ATMOSPHERE

[75] Inventor: Marc J. Robert, Bountiful, Utah

[73] Assignee: Air Liquide America Corporation, Houston, Tex.

[21] Appl. No.: 655,756

[22] Filed: May 30, 1996

[51] Int. Cl.[6] ..... C23C 8/20

[52] U.S. Cl. ..... 148/208; 148/206; 148/231

[58] Field of Search ..... 148/206, 208, 148/216, 218, 230, 231

[56] References Cited

U.S. PATENT DOCUMENTS

| | | | |
|---|---|---|---|
| 2,897,158 | 7/1959 | Sanzenbacher et al. | 252/372 |
| 4,805,881 | 2/1989 | Schultz et al. | 266/257 |
| 5,242,509 | 9/1993 | Rancon et al. | 148/206 |
| 5,259,893 | 11/1993 | Bonner et al. | 148/208 |
| 5,318,759 | 6/1994 | Campbell et al. | 423/351 |
| 5,320,650 | 6/1994 | Simmons | 148/206 |
| 5,320,754 | 6/1994 | Kohn et al. | 210/490 |
| 5,320,818 | 6/1994 | Garg et al. | 148/206 |
| 5,322,549 | 6/1994 | Hayes | 95/45 |
| 5,322,917 | 6/1994 | Auman et al. | 528/185 |
| 5,324,430 | 6/1994 | Chung et al. | 210/500.23 |
| 5,328,503 | 7/1994 | Kumar et al. | 95/101 |
| 5,330,561 | 7/1994 | Kumar et al. | 95/101 |
| 5,332,597 | 7/1994 | Carolan et al. | 427/243 |
| 5,348,592 | 9/1994 | Garg et al. | 148/208 |
| 5,364,476 | 11/1994 | Poor et al. | 148/206 |
| 5,441,581 | 8/1995 | Van Den Sype et al. | 148/206 |

*Primary Examiner*—Scott Kastler

*Attorney, Agent, or Firm*—Burns, Doane, Swecker & Mathis, L.L.P.

[57] ABSTRACT

The process and system according to the present invention are used for the production of an atmosphere. The process involves feeding an impure nitrogen stream, combined with a hydrocarbon to a catalytic reactor having a non-noble metal catalyst to produce a gas which is suitable for use as an atmosphere in furnaces for thermal treatment of metals. The impure nitrogen stream, contains less than 21% oxygen and is preferably produced by a gas membrane system. The system for producing the atmosphere preferably includes a membrane separator, one or more heat exchangers and a catalytic reactor preferably having a nickel catalyst on an alumina support.

14 Claims, 3 Drawing Sheets

ELECTRICAL CONSUMPTION OF GENERATOR OPERATING WITH 97% NITROGEN, 3% OXYGEN AND PROPANE

FIG. 3

| ECONOMICAL COMPARISON | | | |
|---|---|---|---|
| | NEW PROCESS | | |
| | RETROFIT OF RX GENERATOR WITH A NITROGEN GENERATOR | ENDOTHERMIC GAS (RX) DILUTED WITH NITROGEN | METHANOL & NITROGEN PROCESS |
| COMPOSITION: | 8% H2, 5%CO, 87% N2 | 10% H2, 5%CO, 85% N2 | 10% H2, 5%CO, 85% N2 |
| RATE: | 1000 FT3/HR | 1000 FT3/HR | 1000 FT3/HR |
| ANALYSIS | | | |
| CAPITAL COSTS | | | |
| NITROGEN GENERATOR | $32,000.00 | $ - | $ - |
| RX GENERATOR | $38,000.00 | $25,000.00 | $ - |
| STORAGE TANK & MISC. | $ - | $45,000.00 | $72,000.00 |
| CONSUMABLE | | | |
| POWER (KWH/HR) | 5 | 7 | 1 |
| PROPANE (FT3/HR) | 19 | 20 | 0 |
| WATER (GAL/HR) | 20 | 30 | 0 |
| NITROGEN (SCF/HR) | 0 | 750 | 850 |
| METHANOL (GAL/HR) | 0 | 0 | 0.67 |
| FIXED COSTS | | | |
| NITROGEN GENERATOR (18%) | $ 5,760.00 | $ - | $ - |
| RX GENERATOR & MISC. (18%) | $ 6,840.00 | $12,600.00 | $12,960.00 |
| TOTAL COST PER YEAR | $12,600.00 | $12,600.00 | $12,960.00 |
| COST PER THOUSAND CUBIC FEET | $ 2.02 | $ 2.02 | $ 2.08 |
| CONSUMABLE COSTS | | | |
| POWER ($0.07/KWH) | $ 2,184.00 | $ 3,057.00 | $ 437.00 |
| PROPANE ($0.20/#) | $ 2,750.00 | $ 2,895.00 | $ - |
| WATER ($1/1000 GAL) | $ 125.00 | $ 187.00 | $ - |
| NITROGEN ($0.4/100SCF) | $ - | $18,720.00 | $21,216.00 |
| METHANOL ($2.49/GAL) | $ - | $ - | $10,410.00 |
| MAINTENANCE (7% INVESTMENT) | $ 882.00 | $ 932.00 | $ 907.00 |
| TOTAL COST PER YEAR | $ 5,941.00 | $25,791.00 | $32,970.00 |
| COST PER THOUSAND CUBIC FEET | $ 0.95 | $ 4.13 | $ 5.28 |
| TOTAL COST COMPARISON | | | |
| TOTAL ANNUAL COST | $18,541.00 | $38,391.00 | $45,930.00 |
| COST PER THOUSAND CUBIC FEET | $ 2.97 | $ 6.15 | $ 7.36 |

APPARATUS AND PROCESS FOR THE PRODUCTION OF A NEUTRAL ATMOSPHERE

BACKGROUND OF THE INVENTION

1. Field of the Invention

The invention relates to a system and method for the production of a neutral atmosphere for use in processes such as thermal treatment of metals including annealing, tempering, neutral hardening, brazing, sintering, and other processes.

2. Description of the Related Art

Heat treatment furnaces of both the batch and continuous processing type, in which metal workpieces are subjected to various heat treatments, require the use of a neutral protective gas atmosphere. Neutral protective gas atmospheres are made up of a relatively stable gas blend which protects the metallic workpieces against oxidation/reduction and carburization/decarburization. These protective atmospheres are obtained in various ways, such as, by mixing air and methane or other hydrocarbon in an endothermic or exothermic gas generator, by mixing methanol and nitrogen in a vaporizer process, or by diluting endothermic gas with nitrogen or exothermic gas. Neutral protective atmospheres are used in many other industries, such as, the paint manufacturing industry which uses neutral atmospheres when baking pigments in a furnace. Neutral atmospheres are also used for inert blanketing of chemicals by replacing the air in a partially filled container with the protective atmosphere.

Known gas generators are used to produce a neutral gaseous atmosphere by combining air with a hydrocarbon or a hydrocarbon blend in a gas generator. One conventional gas generator includes a retort filled with pieces of a nickel based catalyst which are disposed on a bed of inert pieces of a heat transfer particulate, such as, $Al_2O_3$. The retort is surrounded by a heat source. According to this conventional method, a hydrocarbon and air are routed into the retort and are heated by the surrounding heat source to temperatures of approximately 1900° F. to 2200° F. (1038° C. to 1204° C.). The product gas exiting the retort must then be cooled quickly to below 900° F. (482° C.) to prevent a reversal of the reaction and formation of soot or carbon in the pipes. The cooled product gas may be used in various applications such as heat treatment furnaces. The disadvantages of this conventional process for creating an atmosphere by combining a hydrocarbon and air in a gas generator include the high energy cost required for heating the retort, the high generator operating temperatures required, and the necessary adjustment required by the generator to produce a consistent atmosphere. Another disadvantage is that in order to obtain a more neutral and less reactive atmosphere, the atmosphere must be diluted with nitrogen or exothermic gas.

Nitrogen methanol processes are also used for generating an endothermic carrier gas for use in heat treatment of metal parts. In the nitrogen methanol process, methanol is mixed with nitrogen in a vaporizer and the resulting gas mixture is then reacted in the hot zone of a furnace. The methanol in the furnace reacts and yields a reducing atmosphere of hydrogen and carbon monoxide. Although the nitrogen methanol process has some safety advantages over the gas generator processes, the production cost with the nitrogen methanol process is high and the gas produced is not suitable as a reducing atmosphere in some low temperature treatment processes.

A protective atmosphere may also be produced using an exothermic generator. However, the gas which is produced by an exothermic generator generally must be purified to remove excess water and carbon dioxide which complicates and adds cost to the process.

A known process for forming a thermal treatment atmosphere is disclosed in U.S. Pat. No. 5,242,509 which discloses a catalytic reaction of a hydrocarbon (such as natural gas) with oxygen contained in an impure nitrogen gas stream, both of which flow over a noble metal based catalyst, such as, platinum or palladium on an alumina support. However, at present, the high cost of the noble metal based catalyst required for this process is disadvantageous.

Another known process for forming a thermal treatment atmosphere is disclosed in U.S. Pat. No. 5,259,893 which discloses combining nitrogen gas containing residual oxygen with a hydrocarbon gas in situ inside the hot zone of a furnace. The disadvantages of such an in situ process for forming a thermal treatment gas include the difficulty in maintaining the required temperature of the reacting gas in the reactor due to changes in furnace loading and/or production rates, soothing problems, lack of energy savings, and poor atmosphere composition control.

SUMMARY OF THE INVENTION

The present invention involves a process in which impure nitrogen is combined with a hydrocarbon using a non-noble metal based catalyst to produce a neutral atmosphere. The process according to the present invention operates more efficiently and at lower temperatures than known gas generator processes yet results in an atmosphere which is useful for a variety of applications. Other advantages of the present invention are the ability to increase throughput of an existing gas generator, and the use of a less expensive non-noble metal based catalyst.

According to one embodiment of the invention, a process for producing a neutral atmosphere includes steps of: combining an impure nitrogen stream containing between 0.1% and 21% oxygen by volume with a hydrocarbon to form a feed gas stream, feeding the feed gas stream into a catalytic reactor having a nickel catalyst on an aluminum support, and heating the catalytic reactor to a temperature ranging from about 500° C. to about 1150° C. to produce a neutral atmosphere.

According to another aspect of the invention, a process for producing a neutral atmosphere includes steps of: reducing the oxygen content of an air stream to form an impure nitrogen stream including at least 0.1% oxygen by volume, combining the impure nitrogen stream with a hydrocarbon containing gas to form a feed gas stream, feeding the feed gas stream into a catalytic reactor having a non-noble metal catalyst, and heating the catalytic reactor to a first temperature suitable to produce a neutral atmosphere at said first temperature.

The invention also relates to a system for the production of a neutral atmosphere. The system includes a membrane separator for removing oxygen from a gas stream to produce a reduced oxygen gas mixture, a hydrocarbon supply for combining a hydrocarbon containing gas with the reduced oxygen gas mixture to form a feed gas supply, a catalytic reactor for receiving the feed gas supply, and reacting the reduced oxygen gas mixture and the hydrocarbon over a non-noble metallic catalyst, and means for heating the catalytic reactor to a first temperature.

BRIEF DESCRIPTION OF THE DRAWING FIGURES

The invention will be described in greater detail with reference to the accompanying drawings in which like elements bear like reference numerals, and wherein:

FIG. 3 is an economical comparison between the present invention and two prior art processes which produce similar products.

DETAILED DESCRIPTION

The process according to the present invention involves feeding an impure nitrogen stream, combined with a hydrocarbon or a mixture of hydrocarbons to a catalytic reactor having a non-noble metallic catalyst to produce a gas which is suitable for use as a neutral atmosphere. Such a neutral atmosphere may be used in applications such as in furnaces for the thermal treatments of metals, in the manufacture of pigments, in protection of chemicals by blanketing, or in other applications where exothermic atmospheres are used.

Figure 1:
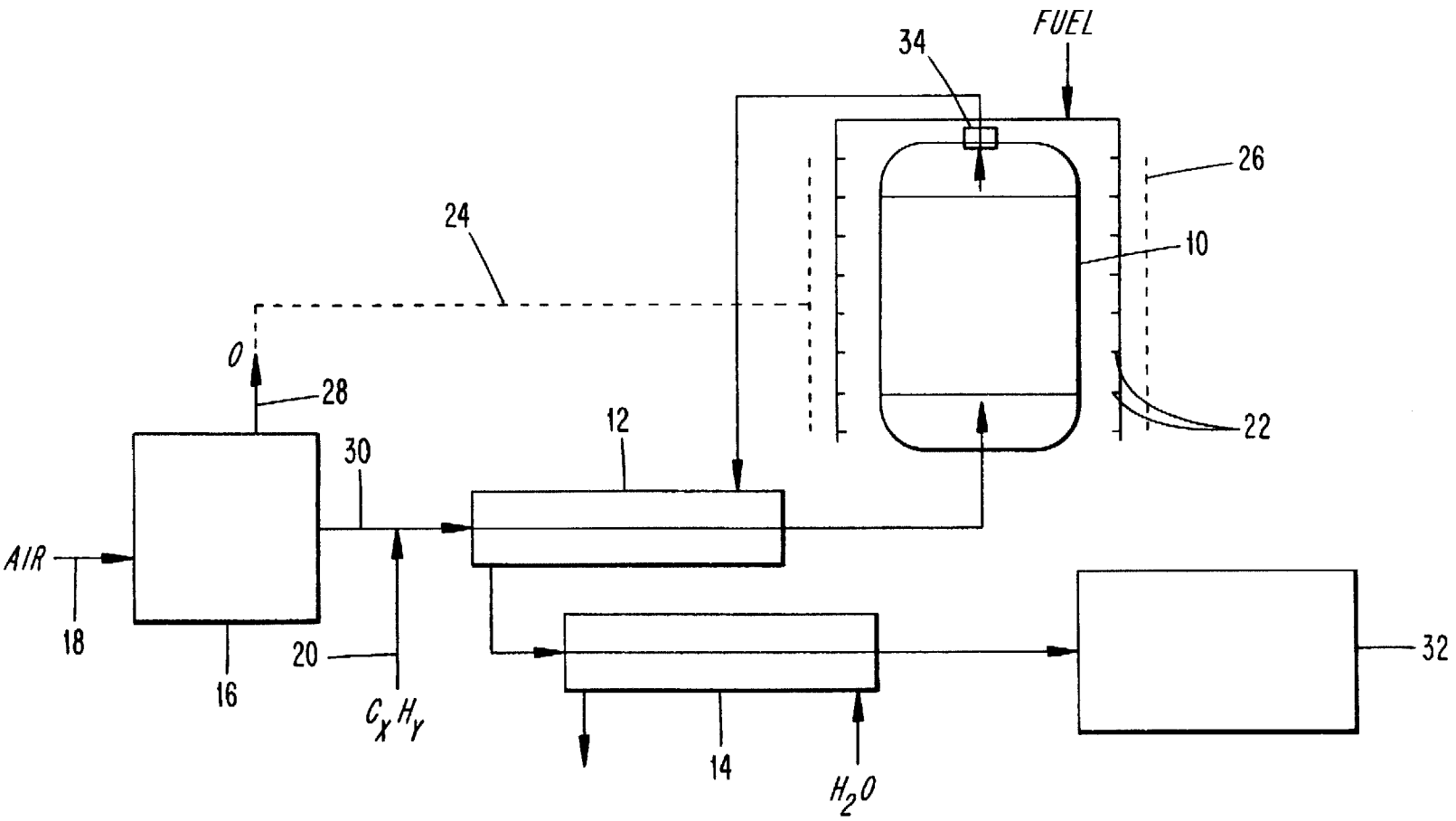
FIG. 1 is a schematic flow diagram illustrating one embodiment of the system according to the invention.

FIG. 1 illustrates a preferred embodiment of the system for the production of the atmosphere according to the present invention. The system of FIG. 1 includes a catalytic reactor 10, a gas/gas heat exchanger 12, a water cooled heat exchanger 14, and a membrane system 16.

Membrane system 16 is adapted to produce an impure nitrogen gas stream from an atmospheric air stream. Membrane system 16 preferably includes an air compressor and a membrane generator such as one of the membrane generators disclosed in U.S. Pat. Nos. 5,332,597, 5,320,818, and 5,318,759. An impure nitrogen gas stream 30 which results from the membrane separation of the membrane system 16 includes 0.1% to 15% oxygen, preferably 2% to 7% oxygen, and more preferably approximately 97% nitrogen and 3% oxygen.

Catalytic reactor 10 includes a non-noble metal catalyst, such as nickel, which is much less expensive than a noble metal catalyst. The non-noble metal catalyst is preferably nickel on an alumina support, however, other known catalysts may also be used. As illustrated in FIG. 1, catalytic reactor 10 is preferably heated by a plurality of burners 22 which are arranged around the outside of the catalytic reactor in such a way so as to achieve uniform heating of the catalytic reactor. Burners 22 are supplied with a fuel, which is preferably natural gas. In addition, a plurality oxygen nozzles 26, illustrated by the dotted line in FIG. 1, may be provided in the vicinity of burners 22 to supplement the atmospheric oxygen in the area of the burners which improves the burner performance and reduces the power/fuel consumption of the system. Oxygen may also be simply mixed with the air supplied to the burner for the same reasons.

The catalytic reactor used in the present invention may be a conventional reactor of any size, for example, a 10 $m^3$/hr (≈350 $ft^3$/hr) or a 30 $m^3$/hr (≈1060 $ft^3$/hr) reactor. However, because the present invention uses an impure nitrogen gas stream 30 which has a reduced amount of oxygen, the throughput of the system is increased by 30% to 40% over the throughputs of known processes. To accommodate this increased throughput, the outlet of a conventional reactor must be enlarged. The catalytic reactor 10 is preferably provided with an outlet 34 having a diameter which may be varied to allow variation of the throughput of the system.

Gas/gas heat exchanger 12, and water cooled heat exchanger 14 are provided for cooling the atmosphere produced by the catalytic reactor 10, and are illustrated schematically in FIG. 1. The heat exchangers may be of any known type including but not limited to plate type or coaxial type heat exchangers. Gas/gas heat exchanger 12 is used not only to cool the gas exiting from catalytic reactor 10 but also serves the function of preheating the feed gas to the catalytic reactor.

In operation of the invention illustrated in FIG. 1, atmospheric air enters membrane system 16 through an air inlet 18 and the air is preferably supplied at high pressure of generally about 175 psig. The compressed air is routed to a membrane (not shown) where a substantial amount of oxygen is removed from the air stream to create two gas streams. A first gas stream 28 exiting membrane system 16 contains a high oxygen content while a second gas stream 30 contains a high nitrogen content and a reduced amount of oxygen. Second gas stream 30 will be referred to below as the impure nitrogen stream. Membrane system 16 removes a substantial portion of the oxygen from the inlet air so that impure nitrogen stream 30 contains less than 21% oxygen. Preferably, the impure nitrogen stream contains 0.1% to 15% oxygen, and more preferably, 2% to 7% oxygen, and 95% to 97% nitrogen. The impure nitrogen stream produced by the membrane system 16 is at a higher temperature than the air feed due to compression by the compressor within the membrane system. This high temperature provides a distinct benefit to the system of the present invention because less energy is required to heat the impure nitrogen stream.

Impure nitrogen gas stream 30 exiting membrane system 16 is combined with a hydrocarbon gas ($C_xH_y$) or a mixture of hydrocarbons to form a feed gas for catalytic reactor 10. The hydrocarbon which is combined with impure nitrogen stream 30 is preferably methane (natural gas), however, other hydrocarbons, including all commercially available fuels, propane, butane, ethane, propylene, or mixtures of different hydrocarbons may also be used. For example, the preferred propane/oxygen ratio is between 1.5 and 1.73. However, this ratio is different for each hydrocarbon which is used. The feed gas then enters gas/gas heat exchanger 12 where the feed gas is preheated by the gaseous product of the catalytic reactor.

The preheated feed gas from gas/gas heat exchanger 12 enters the bottom of catalytic reactor 10 where the impure nitrogen gas reacts with the hydrocarbon in the presence of the non-noble metal catalyst to form a neutral gaseous atmosphere. The resulting neutral atmosphere includes an insignificant amount of oxygen.

Catalytic reactor 10 is heated during the reaction to a temperature of between approximately 500° C. and 1150° C. As illustrated in FIG. 1, catalytic reactor 10 is preferably heated by burners 22 burning a fuel, such as, natural gas. However, the reactor may alternatively be heated by any other known heating means, such as, by electric resistance heating. As illustrated by the dotted line 24 in FIG. 1, high oxygen content gas stream 28 containing approximately 40% oxygen, which is removed by membrane system 16 may be supplied by nozzles 26 to the vicinity of burners 22 to be used to supplement the atmospheric oxygen in the area of burners 22. The supplemental oxygen improves the burner performance and lowers the fuel consumption of the system.

The gaseous atmosphere produced by catalytic reactor 10 leaves the catalytic reactor through outlet 34 at a high temperature of between approximately 500° C. and 1150° C. As discussed above, this high temperature atmosphere is used to preheat the feed gas in gas/gas heat exchanger 12. This also helps to cool the gaseous atmosphere and to prevent the formation of soot in the pipes. The gaseous atmosphere is further cooled in water cooled heat exchanger 14 to a temperature of 400° C. to 900° C., and preferably approximately 480° C. or below to prevent the reversal of the reaction and the accumulation of soot. The gaseous atmosphere exiting the second heat exchanger 14 may be stored or may be used directly in an application 32 such as a the thermal treatment of metal parts, a paint pigment baking furnace, blanketing of chemicals, a wave soldering furnace, a reflow soldering furnace, or other applications.

Although a combination of gas/gas heat exchanger 12 and water/gas exchanger 14 has been described, the invention may also use only one heat exchanger for cooling of the atmosphere. In addition, although heat exchanger 12 has been described for preheating the feed gas, the feed gas may also be preheated in other ways. The feed gas may be preheated by recovering lost energy from the furnace or by employing the high temperature furnace exhaust as a preheater.

The present invention was tested using a 97% nitrogen, 3% oxygen gas stream which is typical of the gas stream which would result from a membrane system of the type described. In the test, the impure nitrogen gas stream was reacted with propane over a nickel on alumina based catalyst in an endothermic generator at temperatures of 900° C.–1050° C. The resulting atmosphere contained 4–5% CO, 6–8% $H_2$, less than 0.3% $CO_2$, 0.3% $CH_4$, and the balance $N_2$ and had a dew point of –20° C. to –30° C. The variations in the composition of the atmosphere obtained in the test are due to the different generator adjustments tested, such as, the hydrocarbon/oxygen ratio and the flow rates. The atmosphere for any particular generator adjustment was found to be very consistent in time. The low $CO_2$ concentrations are representative of the small amount of soot created by the process according to the invention. However, the small amount of soot which was present was created due to an error in the experimental settings. The atmosphere produced by the test was characterized as neutral and slow reacting.

Figure 2:
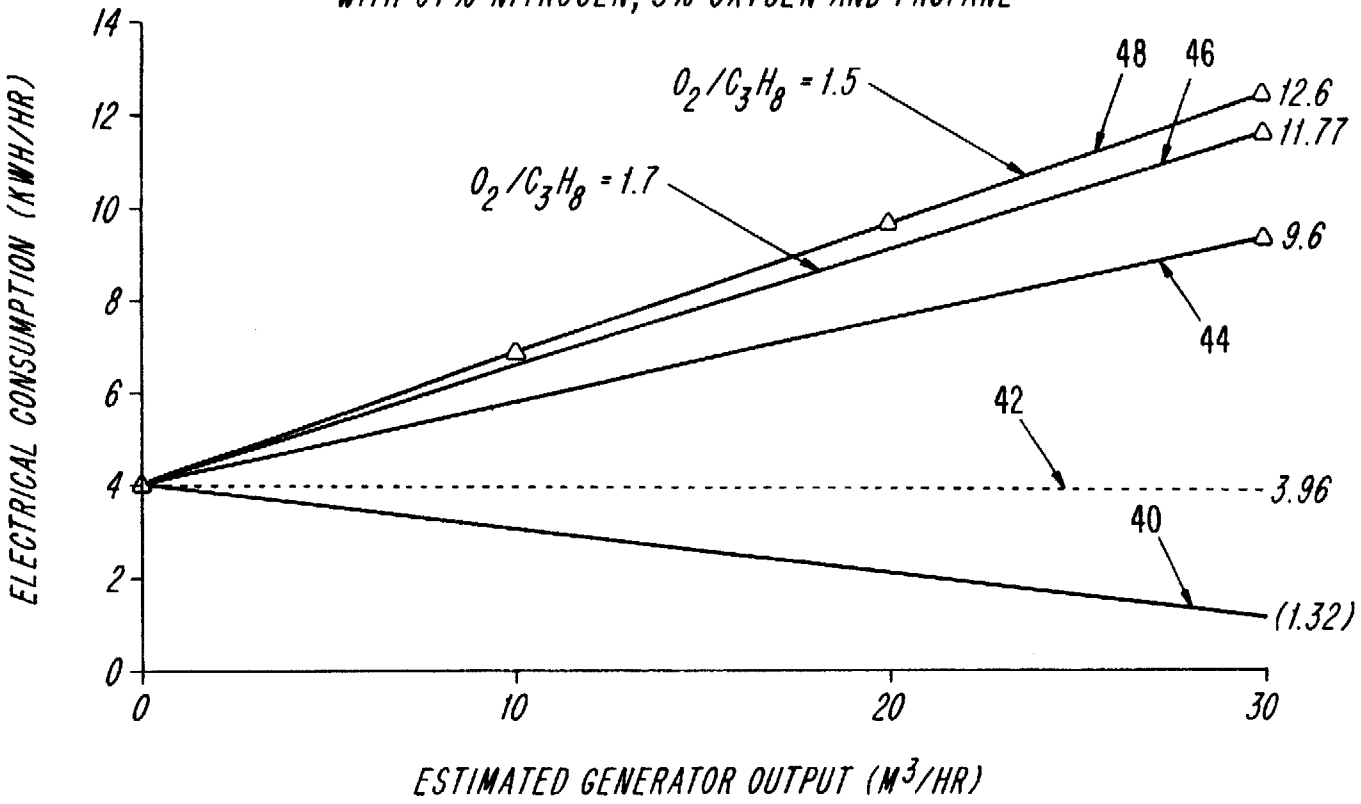
FIG. 2 is a graph of the energy consumption of a catalytic reactor operated according to one aspect of the invention.

The electrical power consumption of the catalytic reactor according to the present invention is illustrated in the graph of FIG. 2. The graph illustrates experimental data of the power consumption of the catalytic reactor 10 for flow rates of output from 0–30 $m^3/h$. A first lowest line 40 on the graph represents the energy loss of the catalytic reactor due to the generator design and includes heat loss from the reactor, such as, through the walls of the reactor. The line 40 represents the calculated power consumption and is not based on experimental data. This power consumption may be reduced by improved insulation of the catalytic reactor. A second line 42 represents the energy loss either due to generator design or due to the cold nitrogen within the reactor. A third line 44 represents the energy loss by the catalytic reactor and by the nitrogen in the catalytic reactor when no reaction takes place.

A fourth line 46 represents the total energy consumption of the catalytic reactor when the ratio of oxygen to hydrocarbon is slightly oxidizing ($O_2$/propane ratio of 1.73). A fifth line 48 represents the total energy consumption of the catalytic reactor for an ideal reaction with an $O_2$/propane ratio of 1.5. As can be seen in FIG. 2, increasing the oxygen flow rate provides more oxygen than the reaction needs and generates heat which reduces the overall energy consumption, and causes the reaction to become more exothermic. Furthermore, preheating nitrogen to the reaction temperature would reduce the energy consumption considerably and shift line 44 toward line 40.

The process according to the present invention, provides an atmosphere which is better suited for neutral hardening and annealing metal. In addition, the present invention operates with lower power consumption, at lower temperatures, and requires less hydrocarbon than the known gas generator processes.

As illustrated in FIG. 3, the method according to the present invention provides a cost savings over both a conventional endothermic gas process, and a methanol and nitrogen process. The endothermic, and methanol and nitrogen processes produce atmospheres which are used in many of the same applications for which the gas produced by the present invention is useful. As illustrated in FIG. 3, the largest cost savings is found in the consumable costs of nitrogen and methanol.

The process according to the present invention, due to its modular configuration is widely adaptable to the needs of customers having existing generators. In addition, no nitrogen backup is necessary since in the event of a problem with the membrane system 16, the catalytic reactor 10 may be used without the membrane system. When used without the membrane system, the apparatus can carry out a conventional gas generator process by combining air and hydrocarbon in the catalytic reactor.

While the invention has been described in detail with reference to a preferred embodiment thereof, it will be apparent to one skilled in the art that various changes can be made, and equivalents employed without departing from the spirit and scope of the invention.

What is claimed is:

1. A process for producing an atmosphere comprising:

combining an impure nitrogen stream containing between 0.1% and 21% oxygen by volume with a hydrocarbon containing gas to form a feed gas stream;

feeding the feed gas stream into a catalytic reactor having a nickel catalyst on an alumina support; and heating the catalytic reactor to a temperature ranging from about 500° C. to about 1150° C. to produce a neutral atmosphere, wherein the catalytic reactor is heated by burners and an oxygen stream is created during formation of the impure nitrogen steam which is used to enhance the performance of the burners.

2. The process for producing a neutral atmosphere according to claim 1, wherein the impure nitrogen stream comprises oxygen having a volume concentration ranging from about 0.1% to about 15%.

3. The process for producing a neutral atmosphere according to claim 2, wherein the impure nitrogen stream comprises oxygen having a volume concentration ranging from about 2% to about 7%.

4. The process for producing a neutral atmosphere according to claim 1, wherein the hydrocarbon is selected from the group consisting of methane, propane, butane, ethane, propylene, and mixtures thereof.

5. A process for producing a neutral atmosphere comprising:

reducing the oxygen content of an air stream to form an impure nitrogen stream including at least 0.1% oxygen by volume;

combining the impure nitrogen stream with a hydrocarbon containing gas to form a feed gas stream;

feeding the feed gas stream into a catalytic reactor having a non-noble metal catalyst; and heating the catalytic reactor to a first temperature suitable to produce an atmosphere at said first temperature, wherein an oxygen rich stream from the membrane separation system is used to improve the performance of burners which are used for heating the catalytic reactor.

6. The process for producing a neutral atmosphere according to claim 5, wherein said first temperature ranges from about 500° C. to about 1150° C.

7. The process for producing a neutral atmosphere according to claim 5, wherein the impure nitrogen stream contains from about 0.1% to about 15% oxygen.

8. The process for producing a neutral atmosphere according to claim 7, wherein the impure nitrogen stream contains from about 2% to about 7% oxygen.

9. The process for producing a neutral atmosphere according to claim 5, wherein the atmosphere is cooled from said first temperature to a second temperature ranging from 400° C. to 900° C.

10. The process for producing a neutral atmosphere according to claim 5, wherein the impure nitrogen stream is created by a membrane separation system.

11. The process for producing a neutral atmosphere according to claim 5, wherein the feed gas stream is preheated by the atmosphere which exits the catalytic reactor.

12. The process for producing a neutral atmosphere according to claim 5, wherein the hydrocarbon containing gas is selected from the groups consisting of methane, propane, butane, ethane, propylene, and mixtures thereof.

13. The process for producing a neutral atmosphere according to claim 5, wherein the impure nitrogen stream is preheated by compression during the reduction of oxygen content.

14. A process for producing an atmosphere comprising:

combining an impure nitrogen stream containing between 0.1% and 21% oxygen by volume with a hydrocarbon containing gas to form a feed gas stream;

feeding the feed gas stream into a catalytic reactor having a nickel catalyst on an alumina support; and heating the catalytic reactor to produce a neutral atmosphere, wherein the catalytic reactor is heated by burners and an oxygen stream is created during formation of the impure nitrogen steam which is used to enhance the performance of the burners.

* * * * *